United States Patent [19]

Favaretto et al.

[11] Patent Number: 4,748,913

[45] Date of Patent: Jun. 7, 1988

[54] POWERED DESK

[75] Inventors: Paolo Favaretto, Padova, Italy; James R. Hayward, Port Perry, Canada

[73] Assignee: Innovative Metal Inc., Rexdale, Canada

[21] Appl. No.: 884,850

[22] Filed: Jul. 11, 1986

Related U.S. Application Data

[63] Continuation of Ser. No. 545,283, Oct. 25, 1983, abandoned.

[30] Foreign Application Priority Data

Oct. 27, 1982 [CA] Canada ..... 414319

[51] Int. Cl.[4] ..... A47B 13/02

[52] U.S. Cl. ..... 108/50; 108/64; 108/153; 312/195

[58] Field of Search ..... 108/50, 23, 41, 64, 108/158, 154, 153, 155, 33; 312/194, 195, 196, 239; 297/232, 248; 174/48, 97, 101; 285/121, 124, 127, 129; 339/23, 24

[56] References Cited

U.S. PATENT DOCUMENTS

| | | | |
|---|---|---|---|
| 378,561 | 2/1888 | Waring | 174/101 X |
| 737,997 | 9/1903 | Burk | 174/97 |
| 783,553 | 2/1905 | Stutzman et al. | 108/158 |
| 1,333,441 | 3/1920 | Ostrander | 16/45 X |
| 1,375,536 | 4/1921 | Ostrander | 16/45 X |
| 2,320,332 | 5/1943 | Morten | 339/23 X |
| 2,499,668 | 3/1950 | Morgan et al. | 108/155 |
| 2,623,448 | 12/1952 | Runefelt . | |
| 3,005,037 | 10/1961 | Miller, Sr. | 339/24 X |
| 3,263,630 | 8/1966 | Carlson | 108/158 |
| 3,351,699 | 11/1967 | Merckle | 174/101 X |
| 3,471,629 | 10/1969 | O'Leary | 174/97 X |
| 3,762,765 | 10/1973 | Piretti | 297/232 X |
| 3,785,600 | 1/1974 | Padovano | 297/248 X |
| 3,973,818 | 8/1976 | Soquenne | 339/24 X |
| 3,982,785 | 9/1976 | Ambasz | 297/248 X |
| 4,043,626 | 8/1977 | Propst et al. | 174/101 X |
| 4,163,537 | 8/1979 | Mourgue | 312/195 X |
| 4,235,495 | 11/1980 | Propst et al. | 339/23 X |
| 4,269,231 | 5/1981 | Happer | 174/97 X |
| 4,323,291 | 4/1982 | Ball | 312/194 |

FOREIGN PATENT DOCUMENTS

| | | | |
|---|---|---|---|
| 6707 | 1/1980 | European Pat. Off. | 108/50 |
| 582008 | 7/1933 | Fed. Rep. of Germany | 339/24 |
| 2448240 | 10/1980 | France | 174/97 |
| 515703 | 12/1939 | United Kingdom | 174/101 |

OTHER PUBLICATIONS

Kinetics Furniture, Powerbeam Desks, 1985, pp. 1–20.
Sunar, Race System, date unknown, pp. 1–12.
Sunar, Race System Planning Guide, date unknown, front page and pp. 14–16.

*Primary Examiner*—Peter A. Aschenbrenner
*Assistant Examiner*—Thomas A. Rendos
*Attorney, Agent, or Firm*—Rogers, Bereskin & Parr

[57] ABSTRACT

A powered desk is described. The desk has a work surface supported by a base consisting of a pair of generally vertical support members connected by an elongate, generally horizontal structural member which has a hollow interior. The ends of the structural member are mounted in annular openings formed in the vertical support members, with end faces exposed and accessible. Electrical connectors are mounted in the opposing end faces and are connected by electrical wiring extending through the interior of the structural member, whereby electric power or signals can be transferred across the full length of the desk and coupled by a suitable jumper to a similar desk. Additionally, electrical connectors are mounted along the surface of the structural member intermediate of the end faces, and tap into the contained electrical wiring to make electric power, telephone signals and other electrically transferred information available at the desk.

17 Claims, 13 Drawing Sheets

POWERED DESK

This is a continuation of application Ser. No. 545,283, filed Oct. 25, 1983, now abandoned.

FIELD OF THE INVENTION

The invention relates to desk construction and more particularly to the problem of making electric power, telephone facilities, access to remote computing machinery or the like conveniently available at a desk.

BACKGROUND OF THE INVENTION

In present day office practice, it is quite common in order to conserve space and to avoid the costly provision of individual offices to locate a number of desks in an open area. Individual work areas may be defined by relatively temporary partitions which are sometimes even free standing. A problem confronted in such an arrangement of office space is the provision of electric power to individual desks without resorting to a multiplicity of conspicuous and obtrusive extension cords. Additionally, one may be confronted with the problem of supplying telephone facilities at such desks, and perhaps access to centrally located computing machinery or other devices intended to provide information along electrical wiring.

One present day solution to the problem of distributing electric power to such an office space is to provide a network of partitions which define individual work areas and which have hollow conduits (generally at the base thereof) which carry electrical supply lines. Electrical outlets are provided at intervals along the conduits to provide power to individual work areas. Such a solution presupposes that partitions are desired and desired at all locations where power might be required. Such a system also has the drawback that extension cords may still be required to make power available at a desk and that numerous other lines must be run in order to provide telephone facilities, data processing access or the like at various desks.

It is an object of the invention to provide a more convenient means for supplying such facilities to a work desk, and additionally to a multiplicity of desks located in an open work area.

BRIEF SUMMARY OF THE INVENTION

The invention provides a desk having a work surface and a base which supports that work surface. The base includes a pair of horizontally spaced-apart support members, and a generally horizontal structural member which connects the support members and which has a hollow interior region. Electrical wiring means are extended through the hollow interior region and serve to couple a first electrical connector accessible at the one end portion of the structural member to at least a second electrical connector located intermediate of the ends of the structural member. Electrical signals or power received at the first electrical connector can be transmitted to the second electrical connector where they become very conveniently available at the desk.

A third electrical connector is preferably provided at an opposite end portion of the horizontal structural member and coupled by the electrical wiring means to the first electrical connector. Such an arrangement permits electrical signals or power to be transmitted for example by a jumper cable to an adjoining desk of similar construction. In this manner electric power, telephone facilities and access to electrically transmitted data can be provided to a multiplicity of proximate desks.

The term "structural" as used in this disclosure and in the appended claims in respect to a generally horizontal members connecting support members of a base is intended to mean that the members so described can so serve to prevent at least in part the relative horizontal displacement of the support members to ensure the structural integrity of the base. The advantage of using such a structural member (with a hollow interior region) to transmit power and signals along a desk is that wiring is conveniently concealed without requiring any special sheathing or conduit which must somehow be secured to a desk.

BRIEF DESCRIPTION OF THE DRAWINGS

Other inventive aspects and objects of the invention will be better understood by reference to the accompanying drawinng in which.

DESCRIPTION OF PREFERRED EMBODIMENT

Figure 1:
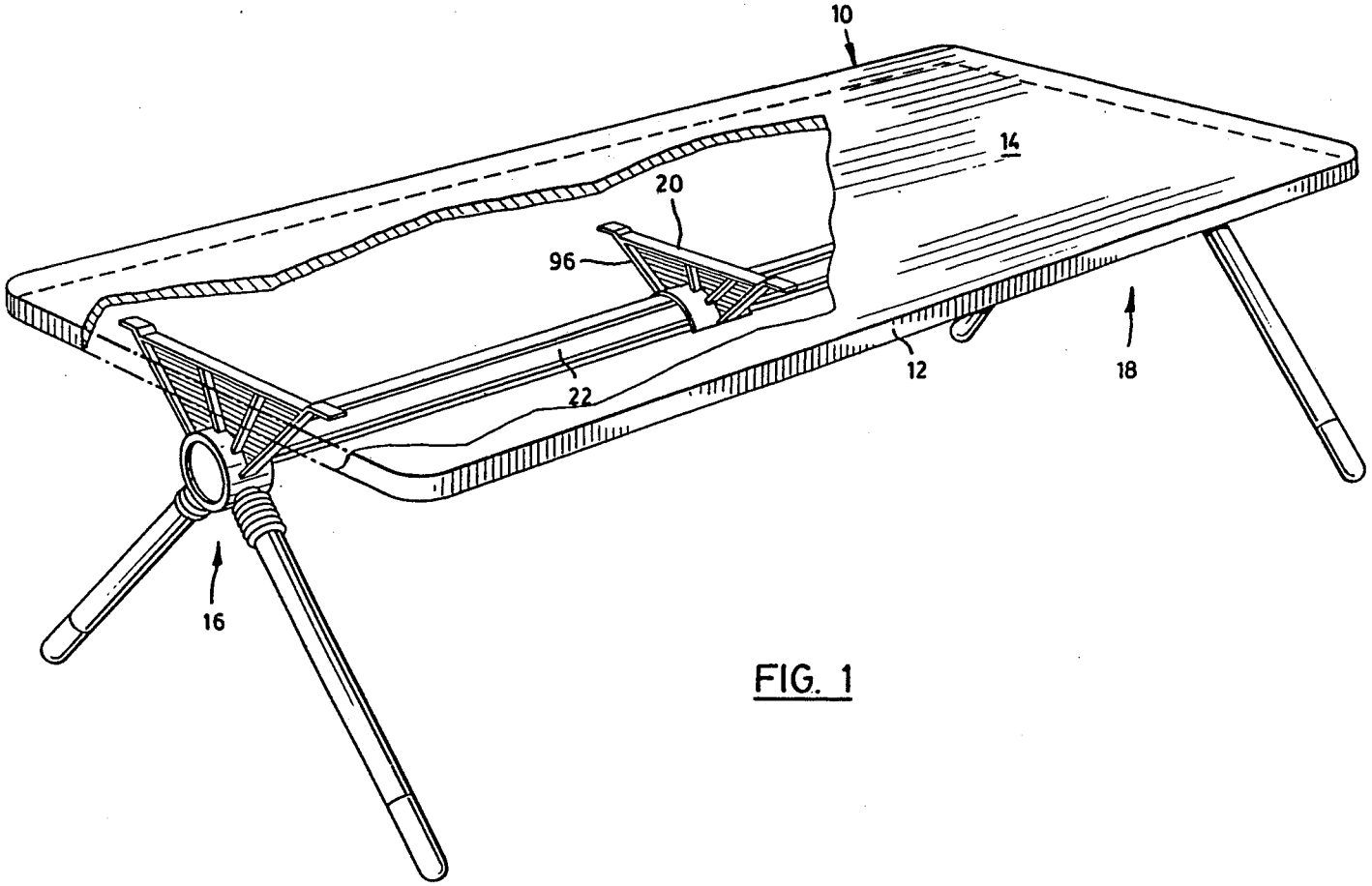
FIG. 1 is a fragmented perspective view of a desk according to one embodiment of the invention.
Figure 2:
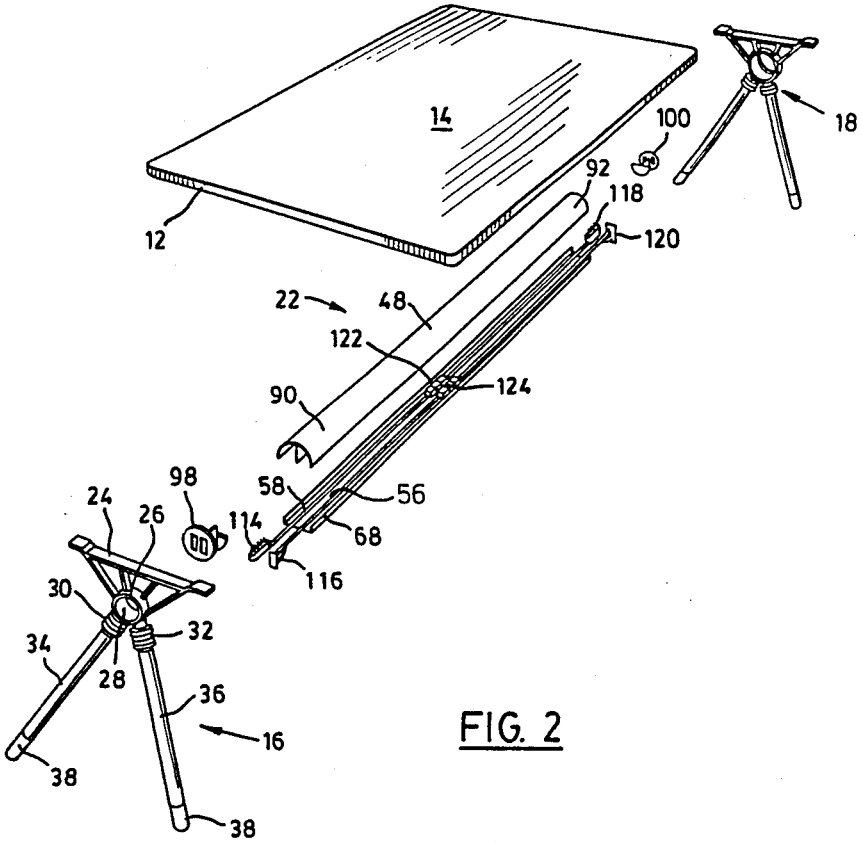
FIG. 2 an exploded perspective view of the desk.

Reference is made to FIGS. 1 and 2 which illustrate a desk 10 which is a preferred embodiment of the invention. A wood slab 12 (fragmented) provides a generally horizontal work surface 14. The wood slab 12 is supported by a base which includes a pair or horizontally spaced support members 16, 18. An optional support member 20 which can provide additional support for the wood slab 12 is shown in FIG. 1, but it is not illustrated in the remaining views. The base includes a generally horizontal structural member 22 which extends between the support members 16, 18. The structural member 22 is the sole means for keeping the support members 16, 18 in the illustrated orientation (the wood slab 12 being screwed to the support members, 16, 18 but providing only marginal restraint against relative displacement).

Figure 5:
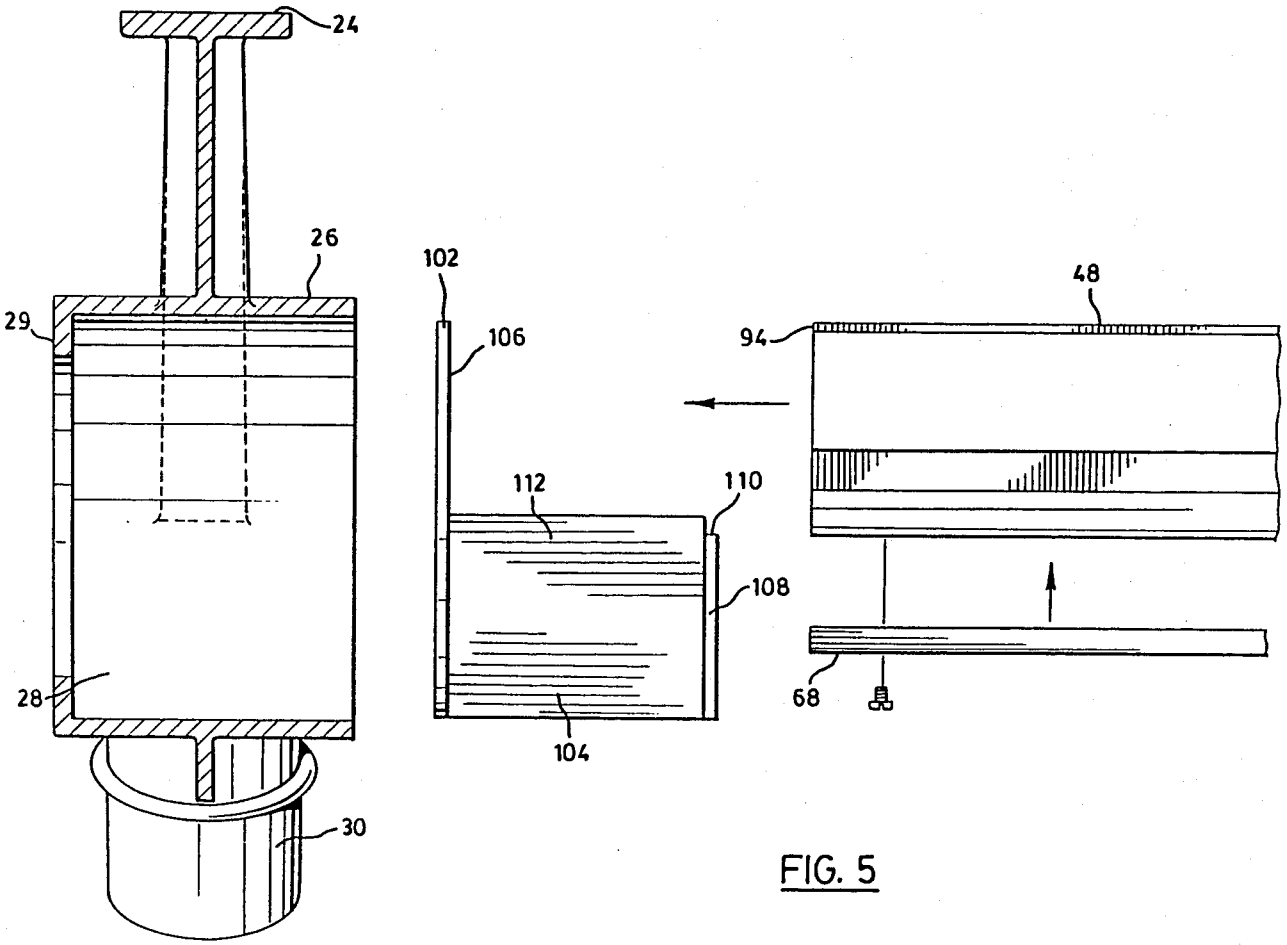
FIG. 5 is a side elevational view of a closure member.
Figure 7:
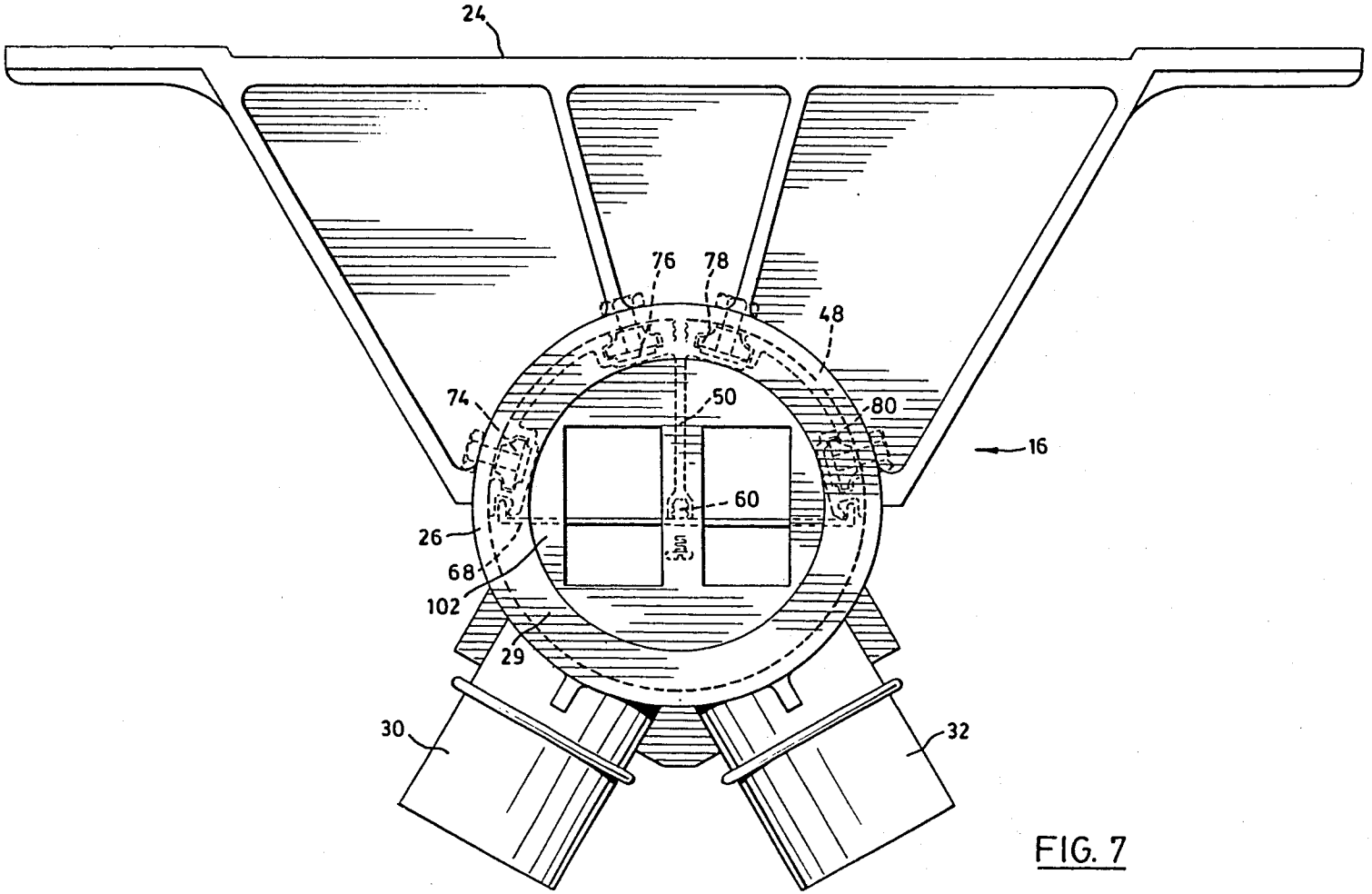
FIG. 7 is an end view better illustrating the mounting of a structural member to a support member.

The support member 16 is typical of the pair of support members 16, 18. The support member 16 includes a truss portion 24, a hub portion 26 with an annular internal surface portion 28 and an annular abutment flange 29 (FIG.5), and a pair of downwardly extending sockets 30, 32, all of which are formed as a single aluminum casting.

The support member 16 has legs 34, 36 formed of steel tubing and terminated with cast aluminum feet 38. The manner of connection of the leg 34 is typical, and will be described. As apparent in FIG. 6, the leg 34 has an extension nipple 40 formed with an external screw thread 42 which is received in complementary threaded engagement in an internal screw thread 44 formed within the socket 30. A sleeve 46 formed with corrugation grips the socket 30 and extends downwardly to conceal the joint connecting the socket 30 and leg 34. The pitch of the threads 42, 44 is sufficiently fine that there is little play between the threads 42, 44. The axial length of the threads 42, 44 is sufficiently great that a significant variation in the height of the work surface 14 can be obtained by rotating the leg 34 relative to the socket 30 (and the leg 36 relative to the socket 32). Such a screw joint might normally not be expected to be a satisfactory method of providing height adjustment for a desk, but by arranging for the legs 34, 36 to diverge away from the bottom of the wood slab 12, the threads joining the legs and sockets tend to bind thereby resisting any wobble. If the extension nipple 40 (which is typical) has a thread diameter of about 1.29 then a pitch of 8 T.P.I. is satisfactory. As the diameter of the extension nipple 40 increases, the thread can be made progressively coarser without introducing noticable wobble.

The truss portion 24 of the support member 16 is attached by means of screws in a very conventional manner to the wood slab 12.

The structural member 22 has an extruded aluminum body member 48. As apparent in FIG. 4, the peripheral cross-section of the body member 48 is generally semicircular except for a number of longitudinal grooves. The body member 48 is extruded with a central wall 50 which divides the interior of thc body member 48 into two separate compartments 52, 54. A first set of wires 56 are normally located in the compartment 52 to carry telephone communications and data, and a second set of wires 58 are normally located in the compartment 54 to carry power. A lower portion of the central wall 50 is forked to provide a longitudinal, downwardly opening groove 60. The side walls 62 defining the groove 60 are formed with linear threads adapted to receive a bolt. Peripheral edges 64 of the body member 48 are also formed with longitudinal grooves 66.

A cover plate 68 extruded of aluminum serves substantially to close the compartments 52, 54. The cover plate 68 has a pair of opposing, upturned flanges 70 which are insertable into the grooves 66 of the body member 48 with the planar body 72 of the cover plate 68 abutting the bottom of the central wall 50. A number of apertures provided along the central axis of the cover plate 68 permit bolts to be threaded into the longitudinal groove 60 at predetermined intervals to secure the cover plate 68. Additionally, the flanges 70 of the cover plate 68 can be formed as a springtype structure which snap fits into the grooves 66 of the body member 48.

The exterior surface of the body member 48 is formed with four longitudinal grooves 74, 76, 78, 80. The groove 74 is typical and has undercut side walls 82, 84 undercut as shown in a cross-sectional view of FIG. 4. A sliding nut 86 is formed with a peripheral flange 88 of generally rectangular shape by means of which the nut 86 is slidably retained within the undercut side walls 82, 84. Similar sliding nuts are inserted into the other longitudinal grooves during assembly of the desk 10 to serve a variety of attachment functions which are described below.

A particular function of the sliding nuts is to secure end portions 90, 92 of the structural member 22 to the support members 16, 18 respectively. The attachment of the end portion 90 is typical, and will be described. Four sliding nuts are located one in each of the grooves 74, 76, 78 and 80 adjacent to the end surface 94 of the body member 48. The end portion 90 is then located within the annular surface portion 28 of the hub portion 26. Bolts are extended through apertures provided in the hub portion 26 to engage the four sliding nuts in order to fix the end portion 92 to hub portion 26.

Sliding nuts are also used to mount the optional support member 20 on the body member 48. The optional support member 20 has an arcuate lower portion which is seated in generally conforming engagement on the exterior surface of the body member 48. A number of apertures extending through the arcuate portion permit bolts to be extended to the longitudinal grooves of the body member 48 to engage sliding nuts previously located in the grooves. A truss portion 96 of the optional support member 20 is then properly positioned to support the wooden slab 12 and is secured thereto by means of screws in a conventional manner. If desired, it is possible to provide vertical support for the work surface 14 through a number of such optional support members mounted at intervals along the structural member 22 with the support members 16, 18 not directly connected to the wooden slab 12 and providing vertical support indirectly.

Closure members 98, 100 are provided at opposite ends of the structural support member 22 primarily for two purposes: to conveniently mount electrical connectors, and to keep the compartments 52, 54 of the body member 48 fully separate at the ends of the structural member 22. The closure member 98 which is typical will be described with reference to FIGS. 2 and 5. The closure member 98 includes a circular plate 102 which conforms generally to the cross-section of the internal annular surface portion 28 of the support member 16. A rectangular plate 104 extends perpendicularly from a back surface 106 of the circular plate 102 and is normally vertically oriented when the desk 10 is fully assembled. A part-circular plate 108 is secured to the rectangular plate 104 in substantially parallel relationship with the circular plate 102 and with a top surface 110 generally perpendicular to the rectangular plate 102. An upper peripheral portion 112 of the plate 104 extends above the top surface 110 of the part-circular plate so that the peripheral portion 112 can be slid into the longitudinal groove 60, where it is gripped by the side walls 62, while the top surface portion 110 of the part-circular plate 108 locates against the body member peripheral edges 64. The longitudinal extent of the cover plate 68 is shorter than that of the body member 48 by a predetermined amount which permits the body member end surface 94 to be abutted against the back surface 106 of the circular plate 102 thereby closing the compartments 52, 54 at that end of the body member 48. The closure member 98 is subsequently retained in such relative orientation by abuttnent of the circular plate 102 against the hub portion flange 29. It will be appreciated that the rectangular plate 104 together with the annular surface portion 28 effectively expand the compartments 52, 54 adjacent the body member end surface 94 to permit mounting of electrical connectors while simultaneously maintaining the separation of the compartments.

Holes have been punched from the circular plate 102 to permit mounting of a telephone and data splice connector 114 and a multi-pole snap connector 116 for transmission of power. As mentioned above, the closure member 100 at the opposite end of the structural member 22 is of substantially identical construction, and carries a corresponding telephone and data splice connector 118 and multi-pole snap connector 120. The wiring 56 couples the connectors 114, 118 to one another and to telephone and data jacks 122 mounted in a hole punched in the cover plate 68. Similarly, the wiring 58 couples the connectors 116, 120 to one another and to a power receptacle 124 mounted in another hole punched in the cover plate 68. It will now be appreciated that the mounting arrangement of the structural member 22 in the annular surface portions of the support member 16, 18 is particularly advantageous as connectors can be mounted in the end surfaces of the structural member 22 and will be conveniently accessible at opposing ends of the base structure for receipt and transmittal of telephone signals, data and power.

Figure 3:
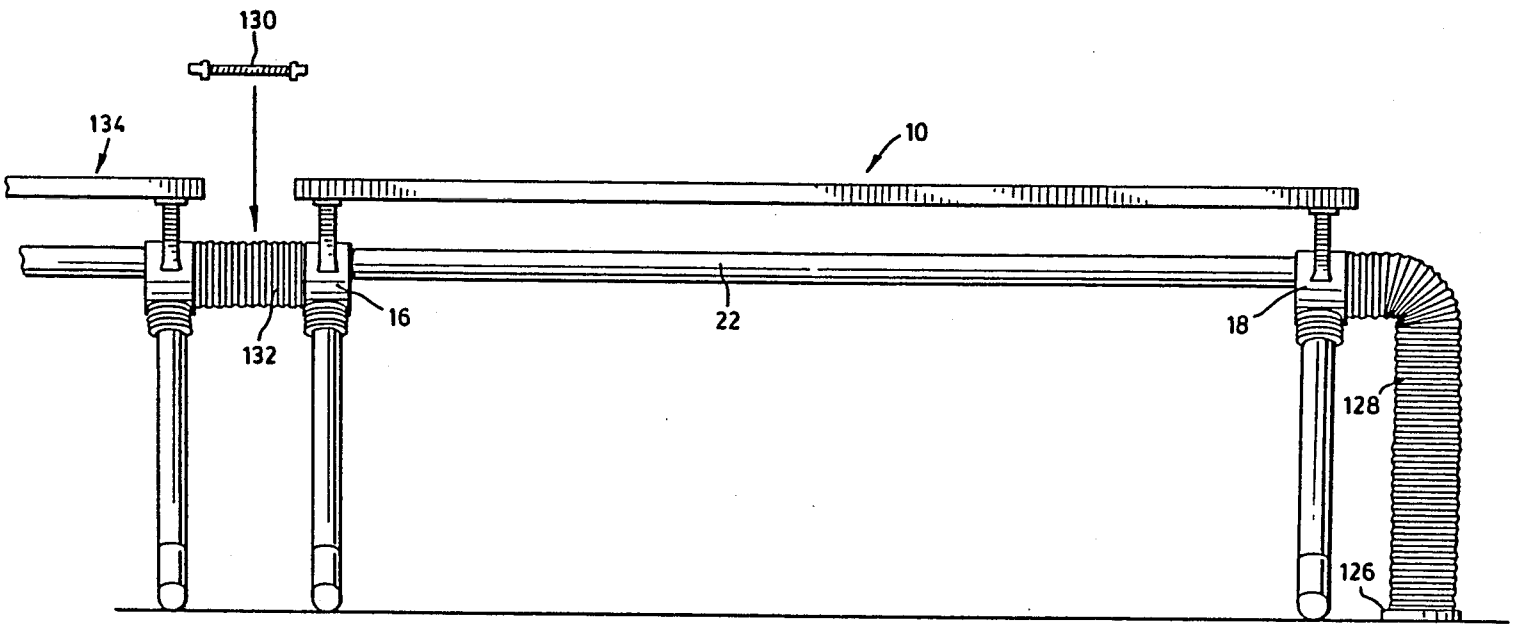
FIG. 3 is a side elevational view illustrating the desk electrically coupled to a second desk (fragmented)

Typical arrangement of desks of the type described above will be apparent from the view of FIG. 3. The splice and snap connectors 118, 120 of the desk 10 are coupled by complimentary connectors and appropriate wiring to power, telephone and data lines made available at a floor receptacle. A corrugated cover 128 serves to conceal the required wiring and complementary connectors. A jumper cable 130 fitted at either end with appropriate snap and splice connectors and normally contained within a corrugated cover 132 electrically couples the desk to a substantially identical desk 134 (fragmented) to permit the transfer of power and electrical signals between the desks 10, 134 and ultimately the floor receptacle 126. It will be appreciated that the desk 134 can be electrically coupled to another desk with a similar jumper cable or that the jumper cable 130 can be replaced with a multi-way jumper cable connecting other similar desks directly to the desk 10. In this manner desks can be laid out in an open work area and various communication and power facilities provided at each of the desks.

An additional advantage of the channeled construction of the structural member body portion 48 is that a number of supplementary sliding nuts can be located in the channels during assembly for mounting of miscellaneous equipment and the like to the structural member 22. Such equipment can be positioned at any convenient location along the structural member 22 and can markedly improve the organization of work space. Sliding bolts can be provided instead of nuts by forming appropriate retaining flanges on the heads of the bolts, to attach equipment and the like and even optional support structure such as the support member 20. However, use of sliding bolts is preferably avoided because such bolts would be obtrusive, and additionally, unless bolts in separate channels are appropriately angled, or the channels appropriately oriented, then both will tend to be directed along diverging axes, making mounting of devices or structure particularly difficult.

FIGS. 8 to 15 illustrate various desks in accordance with further embodiments of the invention.

Figure 8:
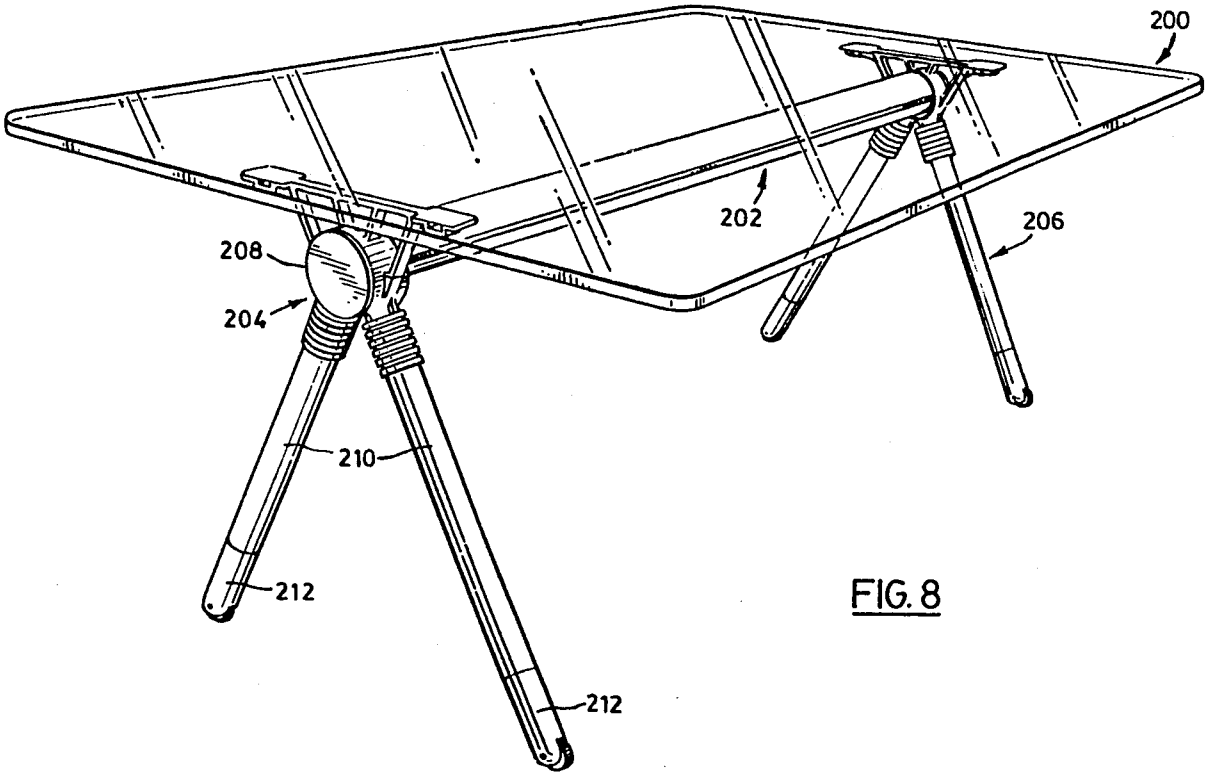
FIG. 8 is a perspective view of a desk according to a further, preferred embodiment of the invention.

Referring first to FIG. 8, it will be seen that the desk is generally quite similar to the desk shown in FIG. 1 in that it comprises a top 200 supported by a base comprising a main structural member or beam 202 which extends longitudinally of and below the top 200 and which is provided at its ends with support members generally denoted 204 and 206 in the form of leg assemblies. These particular leg assemblies are of inverted V-shape and are essentially the same. Referring to leg assembly 204 by way of example, it will be seen that the assembly comprises a central hub 208 and two legs 210 which extend downwardly from the hub. Feet 212 are provided at the lower ends of the legs.

Figure 9:
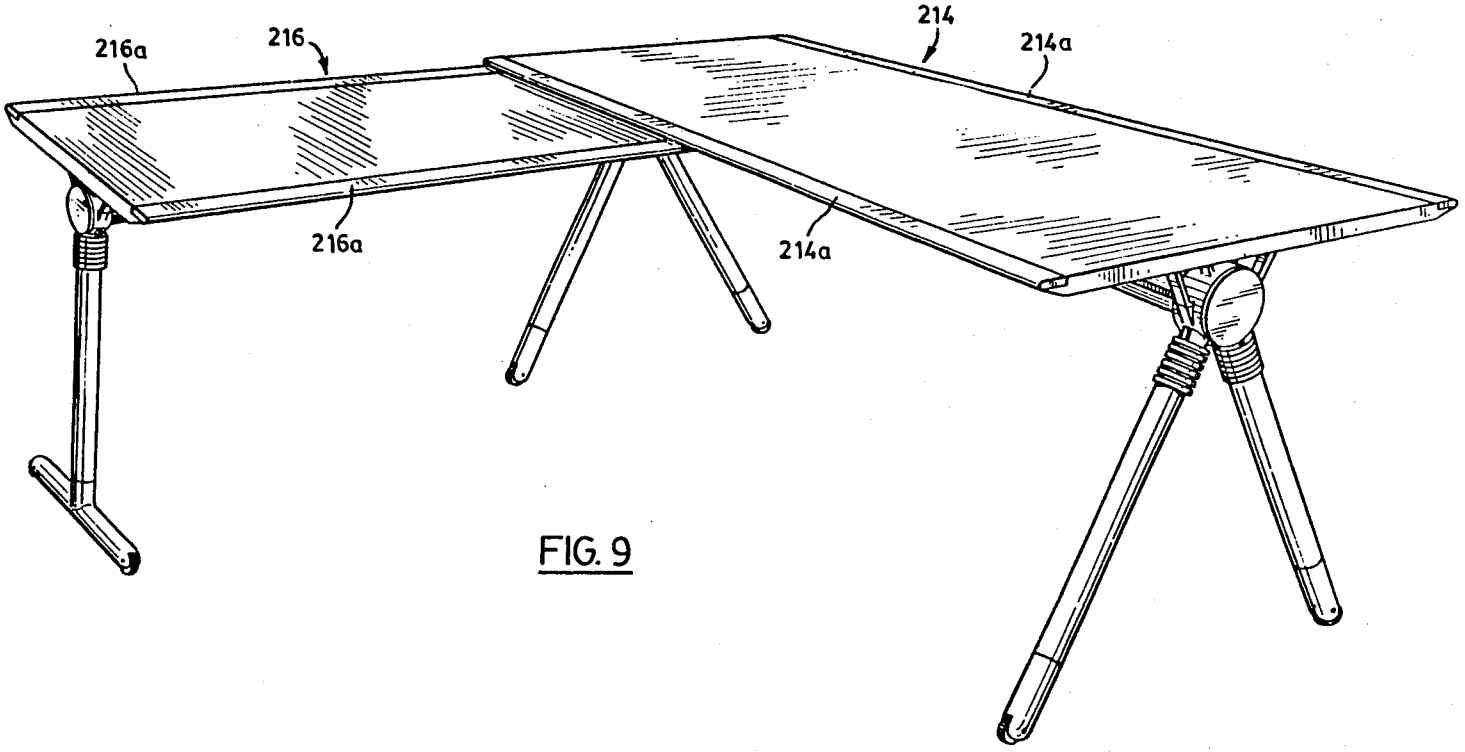
FIG. 9 is a view similar to FIG. 8 showing an alternative form of desk provided with a runoff.
Figure 10:
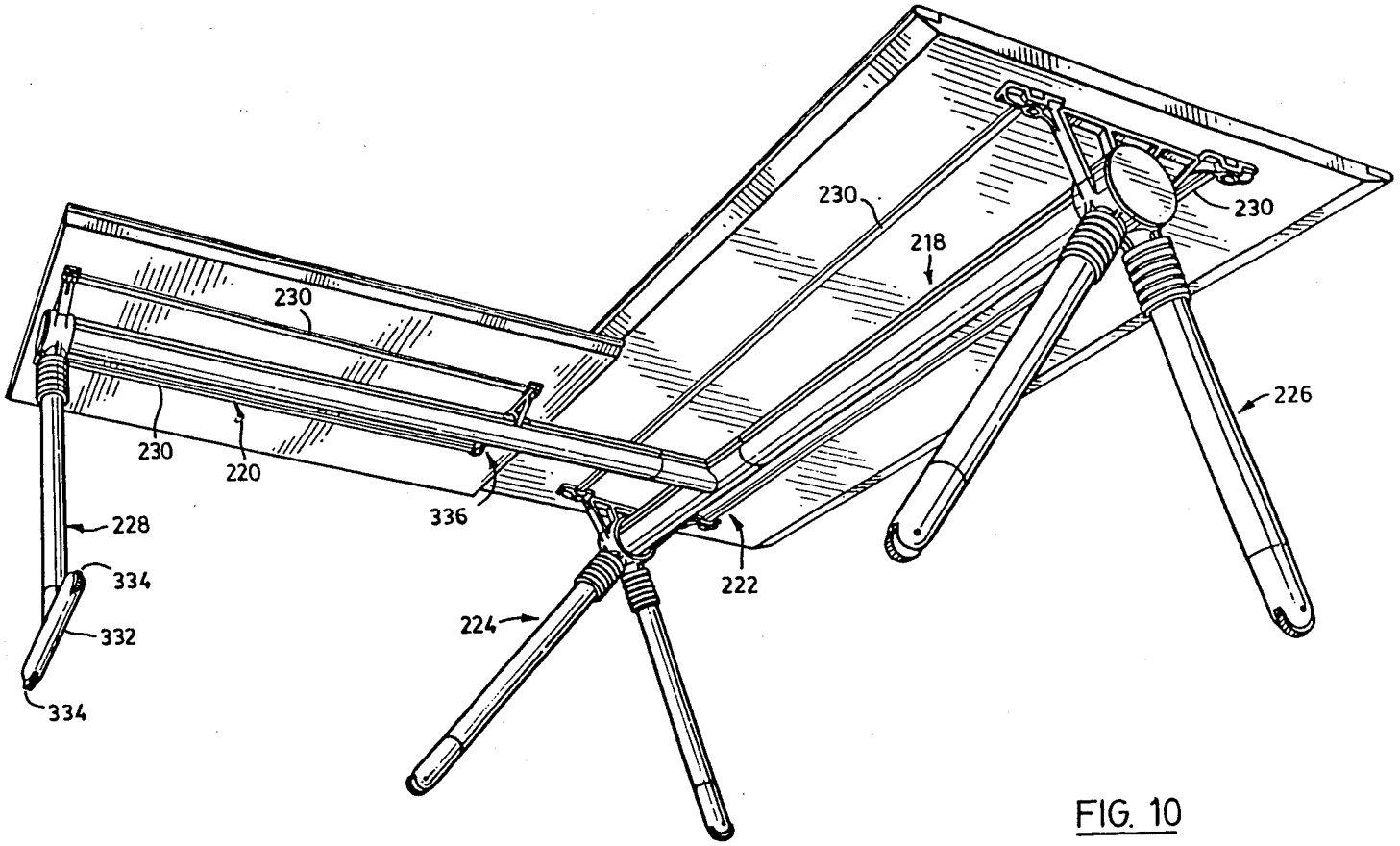
FIG. 10 is an underneath perspective view corresponding to 9.
Figure 13:
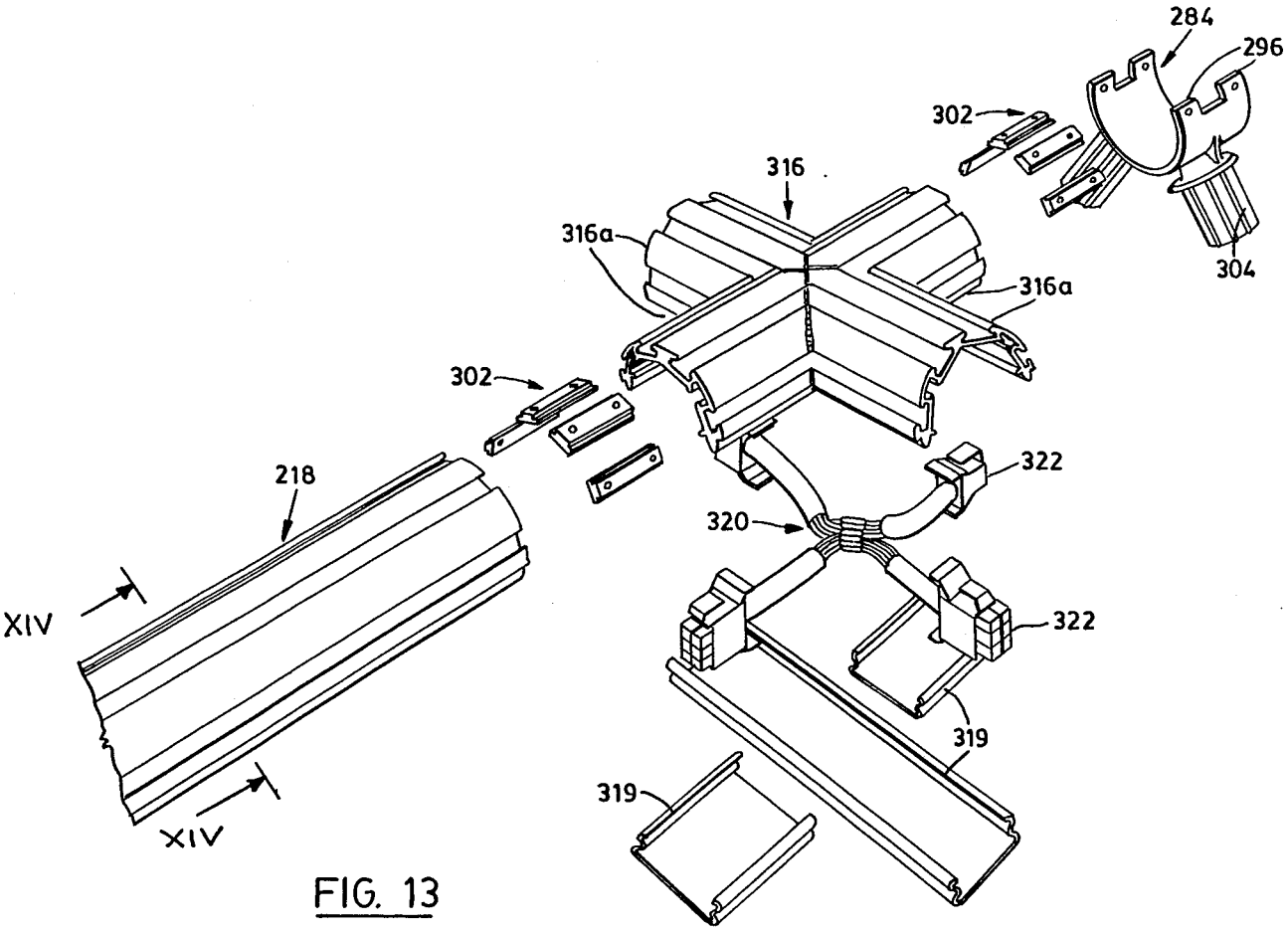
FIG. 13 is an exploded perspective view showing a beam connector assembly.

The desk shown in FIGS. 9 and 10 is essentially constructed in similar fashion but is generally L-shaped overall. Thus, the desk has two tops 214 and 216 arranged at right angles with respect to one another, and a corresondingly shaped base which is best seen in FIG. 10. Two beams 218 and 220 are provided below the respective tops and are essentially of the same form as beam 202. However, it will be seen that beam 220 is connected into and extends outwardly at right angles from beam 218 by a beam connector assembly generally denoted 222. This assembly is constructed as illustrated in FIG. 13 (to be described) but is T-shaped instead of the crossed shape assembly shown in that view.

Referring back to FIG. 10, beam 218 is provided at its ends with respective leg assemblies 224 and 226 which are essentially the same as the assemblies 204 and 206 shown in FIG. 8. Beam 220 is also provided with a leg assembly 228 at its outer end but in this case the assembly is of inverted T-shape as will be more particularly described later.

A comparison between FIG. 8 on the one hand and FIGS. 9 and 10 on the other serves to illustrate some of the many configurations in which desks may be constructed in accordance with the invention. For example, in FIG. 8, the desk is provided with a glass top 200 while in FIGS. 10 and 11, the tops 214 and 216 are wooden and have upwardly chamfered side edges provided with inset edge detail strips **216*a* and 214*a* respectively. Also, the two tops 214 and 216 are arranged at different heights in the manner of a conventional runoff desk configuration. FIG. 10 illustrates the fact that the two tops are provided on their undersides with parallel extruded aluminum channels 230** which co-operate with the base as will be described. These channels allow the tops to be fitted to the respective bases after the bases have been assembled and provided with appropriate wiring, which greatly facilitates installation of a desk system in a given office environment.

Figure 11:
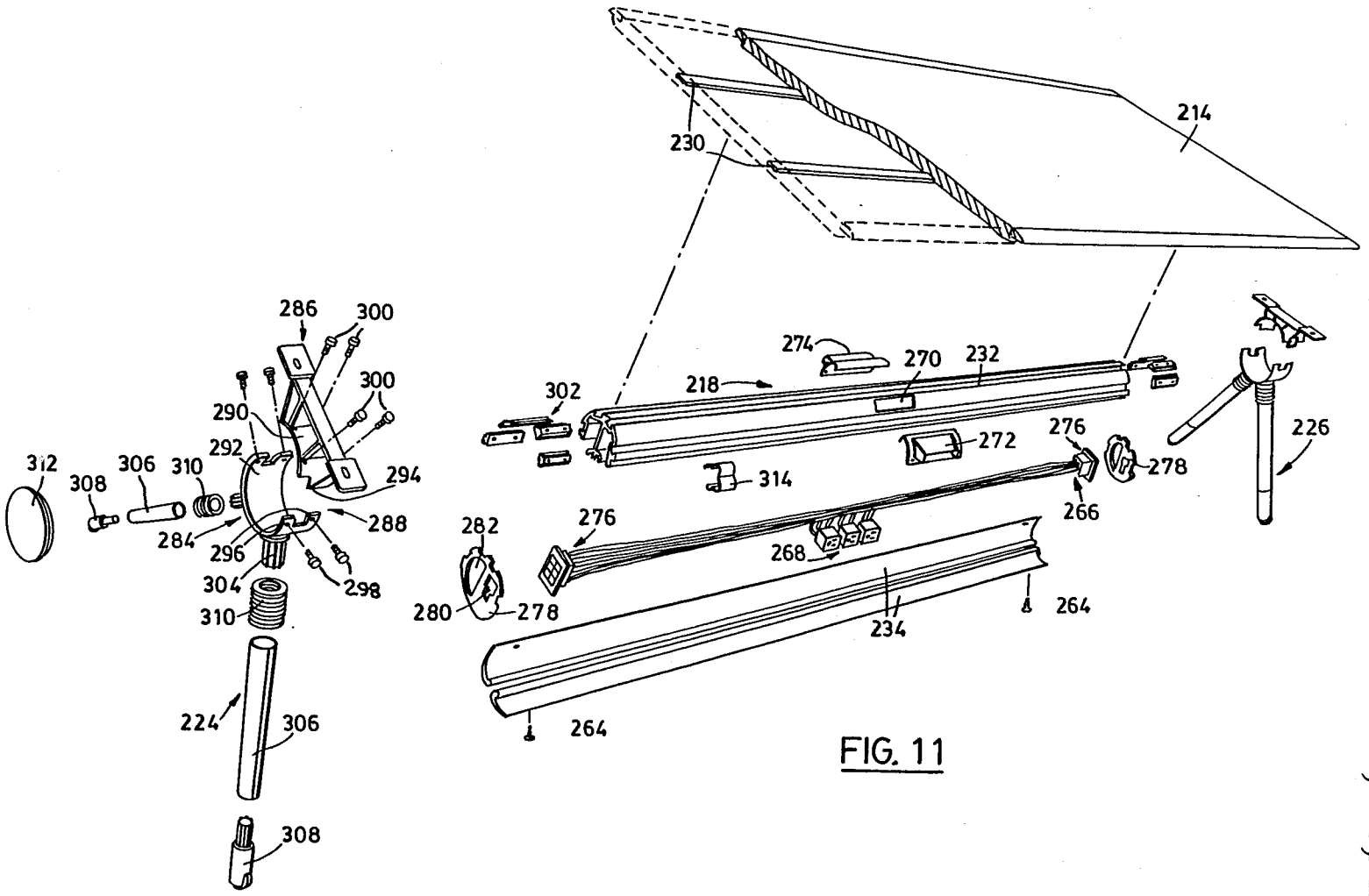
FIG. 11 is an exploded perspective view of part of the desk of FIG. 10.

Reference will now be made to FIG. 11 in describing various structural features of the desks shown in FIGS. 8, 9 and 10. FIG. 11 may be considered to be an exploded perspective view of a rectangular desk corresponding to the part of the L-shaped desk of FIG. 9 which appears at the right-hand side of that view in that the desk of FIG. 11 has a solid rectangular top and a base comprising an elongate structural beam and two leg assemblies of inverted V-shape. The reference nuemrals used in FIGS. 9 and 10 will therefore also be used in FIG. 11 to denote corresponding parts although it is of course to be understood that the structural features of the components shown in FIG. 11 also apply to FIG. 9 and that many other desk configurations can be constructed using these same components.

Figure 4:
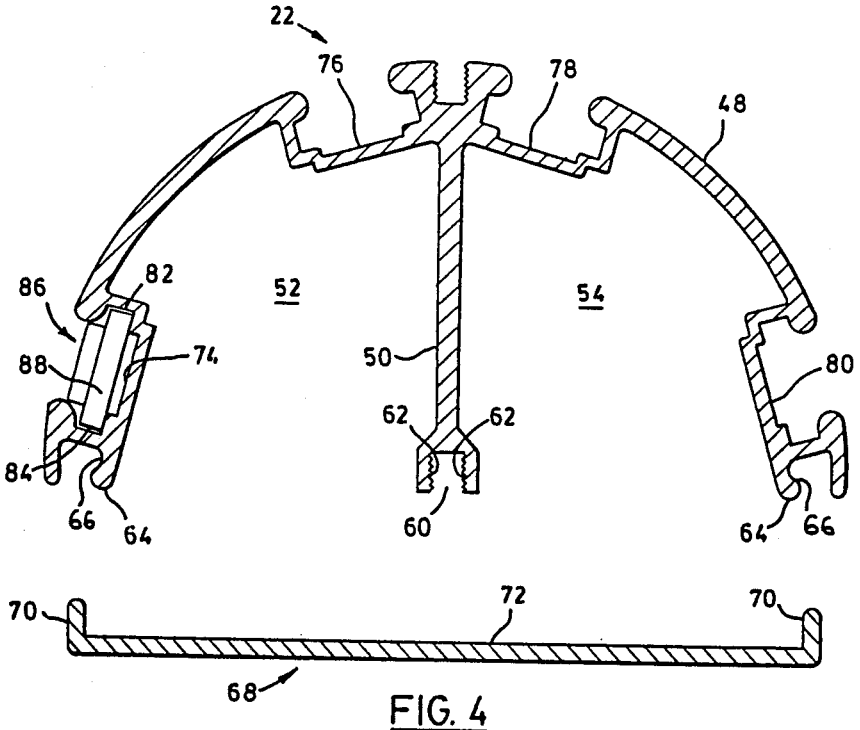
FIG. 4 is a cross-sectional view along a longitudinal axis of a horizontal structural member in the base of the desk with a cover plate exploded away from the remainder of the member.

Referring now to FIG. 11 in more detail, it will be seen that the beam 218 has an upper part of body member 232 which is generally similar to the member shown in FIG. 4 but that, instead of the fixed cover 68 of FIG. 4, beam 218 is provided with two doors 234 which are hinged to the body member so that the doors can be selectively pivoted between positions in which they close the compartments within the beam and positions in which either or both doors hang down from the beam and provide access to the relevant compartment or compartments from below.

Figure 12:
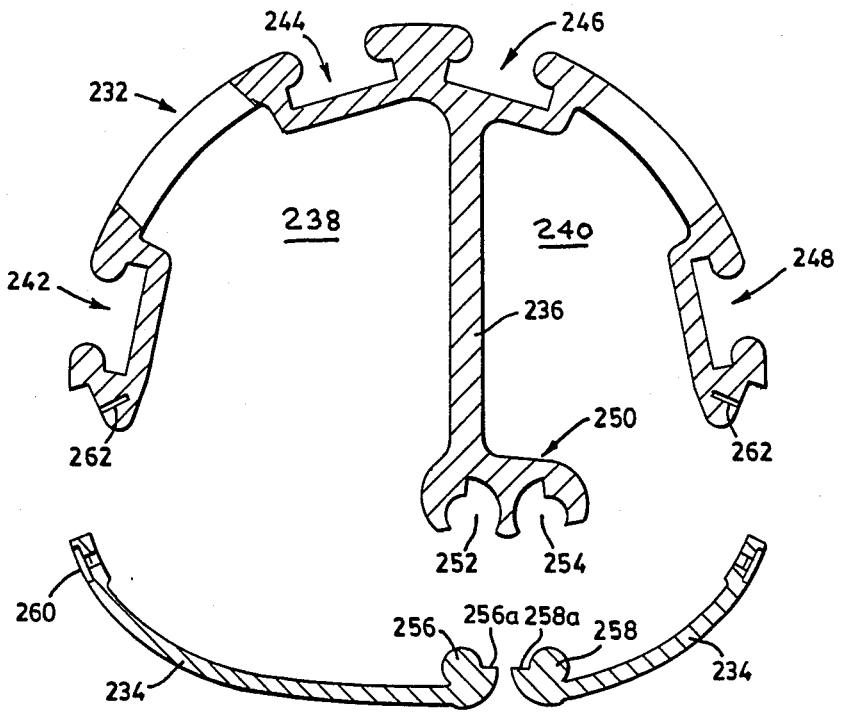
FIG. 12 is a cross-sectional view, partly exploded through the main structural member or beam of the desk shown in FIG. 11.

FIG. 12 shows the cross-sectional shape of the body member 232 and the doors 234 in more detail. As noted, the body member is essentially very similar to the member 48 of FIG. 4 in that it is generally of somewhat arcuate shape in cross-section with a dividing wall 236 forming compartments 238 and 240 for receiving, respectively, communications and power wiring. The outer wall of member 232 is formed with four grooves or channels 242, 244, 246 and 248 which are of undercut generally inverted T-shape in cross-section and are similar to the grooves shown in FIG. 4. At the lower end of wall 236 is a formation 250 formed at its lower end with a pair of elongate recesses 252 and 254 shaped to receive generally complimentary formations 256 and 258 respectively at the inner ends of the respective doors. The doors are shown exploded below member 232 in FIG. 12 but the beam is designed so that the formations 256 and 258 can snap-fit into the respective recesses and will then allow the doors to pivot between the generally horizontal (closed positions) in which they are shown in FIG. 12 and positions in which the doors hang down below the beam for providing access to the compartments 238 and 240. At this time, faces 256*a* and 258*a* on the formations abut against corresponding faces in the respective recesses to define the open position of the doors. Member 232 and each of the doors 234 are aluminum extrusions and as such can be made in any required length. The shapes and dimensions of the extrusions are selected to allow the required limited flexure to permit the formations to be snap-fitted into the member 232.

It will be understood that, in normal use, once a desk has been wired the doors 234 will be closed and will remain closed until alteration or additions to the wiring are required. Each door will be held in its closed position by a pair of screws (one adjacent each end) and each extending through an opening 260 adjacent the outer edge of the relevant door and into a corresponding slot 262 formed in the extrusion 232. In FIG. 11, two typical screws are shown at 264.

FIG. 11 also shows a wiring harness 266 positioned below the upper part 232 of beam 218. In practice, the harness will be inserted upwardly into the beam compartment 240 and then enclosed by the relevant one of the two doors 234. Harness 266 incorporates a series of electrical receptacles 268 which extend through a cut-out 270 communicating with beam compartment 240. A hood 272 is snap-fitted into cut-out 270 and serves as a mounting for the receptacles 268. A similar cut-out (not shown) and hood 274 are provided at the communications side of the beam. Hood 274 has a plastic knock-out (not shown) which is removed to provide access through the hood for cables as required.

At its ends, the wiring harness 266 is provided with so-called Anderson 6-pole type snap connectors 276 which are fitted into respective plastic moulded end plates 278 which are mounted flat against the ends of the beam as will be described. Each end plate has two openings 280 and 282. Opening 280 receives the relevant connector 276 while the other opening provides access for communications cables. Thus, in the assembled desk, the two connectors 276 are exposed at the ends of the beam upper part 232 for receiving corresponding male connectors for providing power to the receptacles 268 and permitting power to flow through the desk to or from other equipment or adjacent desks for example by way of jumper cables or extension cords.

It will of course be appreciated that the particular wiring harness shown at 266 is a representative example only and that other wiring arrangements can of course be provided as called for by the particular application required of the desk.

As noted previously, each of the leg assemblies 224, 226 includes a hub which is coupled to the beam 218. Referring to leg assembly 224 by way of example, its hub is denoted 284 and comprises separate upper and lower parts 286 and 288 respectively. The two parts of aluminum castings (but may be moulded in a suitable glass filled plastic material) and are shaped to interfit and define an annular structure dimensioned to embrace the beam 218. Thus, the upper part 286 has an arcuate section 290 which fits snugly over the top portion of body member 232 while the lower part 288 has a corresponding arcuate section 292. As can be seen from FIGS. 8, 9 and 10, when the two parts are fitted together, the sections 290 and 292 together define a generally annular form surrounding the beam. At each side, section 290 has a depending tongue as tongue 294 which is received between a corresponding pair of projections 296 on section 292 of the lower part. This tongue and slot arrangement ensures accurate alignment of the two hub parts along the beam.

In addition, each hub part is independently bolted to the body member 232 of the beam. The two projections 296 at each side of the lower part are formed with openings for receiving a pair of screws 298 while the upper hub part is provided with two pairs of aligned openings for receiving screws 300. Each pair of screws is designed to be received in a corresponding pair of threaded apertures in a sliding nut or spline designed to be received in the relevant one of grooves 242, 244, 246 or 248 in member 232. In FIG. 11, four such splines are collectively denoted 302 and are shown spaced outwardly from the respective grooves in member 232. The two splines which are shown at the center would be engaged by the bolts 300 through the upper hub part 286 while the two splines at the sides would be engaged by the bolts 298 through the lower hub part. In each case, the spline will be drawn against the undercut portion of the groove generally as described in connection with FIG. 4. The splines also extend through notches in the peripheral edges of the respective end plates 278 for securing those plates in position.

The upper hub part 286 serves to support the desk top 214 and is of bridge-like truss construction generally as described in connection with FIG. 2. The support is designed to engage in the channels 230 at the underside of the desk top so that the desk top can slide with respect to the hub, for adjustment purposes.

The lower hub part 284 as shown in FIG. 11 includes a pair of integral spigots 304 which are press-fitted into the upper ends of tubular legs 306 fitted with feet 308 at their lower ends. In this embodiment, the legs are made of hollow steel tube and the joint between the hub and the tube is covered by a decorative plastic moulded bellows 310. A decorative end cap 312 is also provided for the hub and can be snap-fitted into the hub from its outer side. Removal of the end cap provides access to the relevant one of the two Anderson connectors 276 for coupling the desk to another desk or other equipment.

FIG. 11 also shows an external clip or "wire manager" 314 which can be clipped into the grooves in the beam for securing external wiring such as electrical cords to associated equipment.

Figure 14:
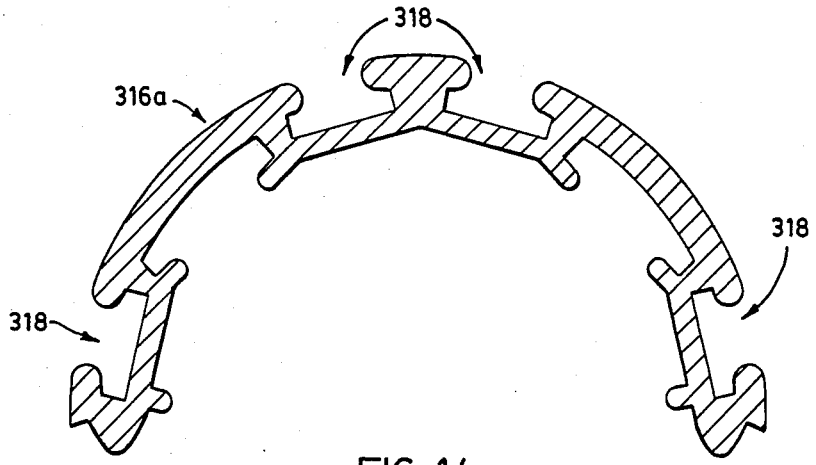
FIG. 14 is a cross-sectional view generally on line XIV—XIV of FIG. 13; and, FIG. 15 is an elevational view showing one of the feet at the lower end of one of the desk legs.

FIGS. 13 and 14 illustrate a beam connector assembly by which two beams can be joined for example as in the case of the beams 218 and 220 in FIG. 10. In FIG. 13, the assembly itself is denoted 316 and has a crossed configuration overall. Associated components have been shown in exploded positions in association with the connector and are denoted by the same reference numerals as those used in FIG. 11. The connector itself, is made up of four identical sections 316*a*, the cross-sectional shape of which is shown in FIG. 14. It will be seen that each section generally follows the cross-sectional shape of the upper part of the beam and includes four external grooves, each denoted 318, which align with the grooves in the beam upper part. This allows the connector to be secured to adjacent beam sections by splines 302 which extend between the beam section and the connector and are retained in the channels of both generally in the same fashion as the splines used to connect the hubs.

Internally the sections 316 are open (they have no wall as wall 236 [FIG. 12]). The sections are mitered and welded together in the required configuration. FIG. 13 shows only one such configuration although many are of course possible. These would include the T configuration of FIG. 10 as well as 45° and 30° angle configurations.

Unlike the beam itself, the connector is not provided with hinge doors. Rather, plastic moulded snap-fit covers such as those indicated at 319 are provided and are designed to snap into the sections from below.

FIG. 13 illustrates how a four-way Anderson jumper cable 320 can be used in the connector 316. Connectors 322 at the ends of the cable are designed to snap-fit with other connectors, as connector 276 in FIG. 11. Again, the particular configuration of the connector will vary according to the desk layout required.

Figure 15:
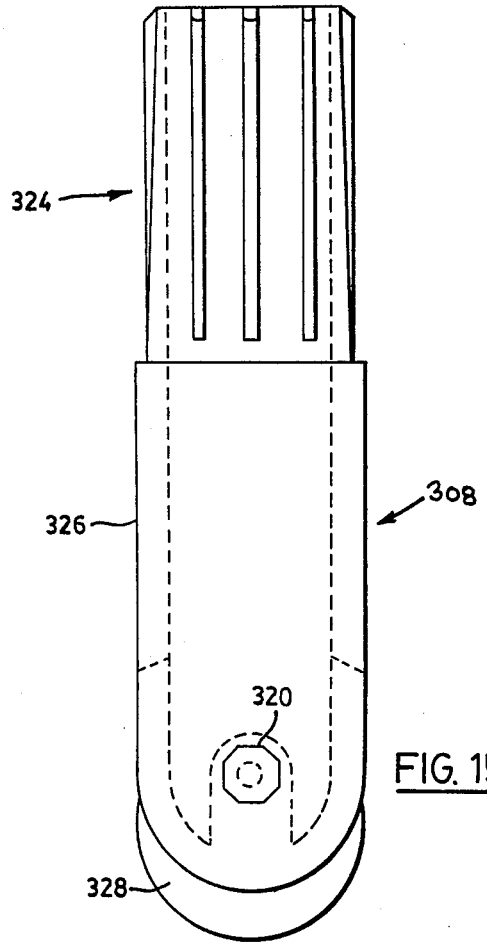

Finally, FIG. 15 shows one of the feet 308 at the lower end of one of the legs of the desk. The foot is an aluminum casting (although again a glass filled plastic may be used) and is shaped to define a spigot 324 which can be push-fitted into the lower end of one of the legs 306. Below the spigot, the lower end of the foot, denoted 326 is slotted to receive a wheel 328 having an eccentric center opening. A shouldered bolt 320 extends through that opening and is threaded into the casting at the far side of the wheel as seen in FIG. 15. The shouldered portion (not shown) of the bolt presses against one side of the wheel to urge the opposite side of the wheel into frictional engagement with the wall of the slot. In this way, the wheel can be frictionally locked against turning with respect to the foot. The fact that the wheel is eccentric allows it to be used to vary the height of the leg, for levelling purposes.

In the case of the inverted T-shaped leg shown at 228 in FIG. 10, the hub assembly is essentially the same as that which has been described in connection with FIG. 11 except in that the lower part of the hub has a single depending spigot corresponding to the single leg. Again, the leg is tubular. The foot itself is again a casting or moulding and is denoted by reference numeral 332 in FIG. 10. Levelling wheels 334 generally of the form shown in FIG. 15 are provided at the ends of the foot.

FIG. 10 also shows an optional desk top support 336 which may be used for supporting a desk top other than at the position of a leg. This support generally corresponds to the top half of a hub section and is locked into two of the grooves in the beam in the same way as the hub part. It will also be undersood from FIG. 10 that the height of the upper hub part may vary according to the required desk top height. In FIG. 10, the supports below the runoff are of less height than the supports below desk top 214 to provide the normal height differential between the two parts of a L-shaped desk.

It will be appreciated from the foregoing that a desk of the form provided by the invention can be constructed in many different configurations and lay-outs as required by the office environment. The electrical and communications wiring can be rooted as required, wholly within the structural beams of the desks. The beams can be "hard wired" with wiring harnesses, an exmaple of which was described in connection with FIG. 11, or the desks can be individually wired as required. In either case, it is possible to avoid unsightly and untidy wiring such as is often associated with conventional desk installations.

Figure 6:
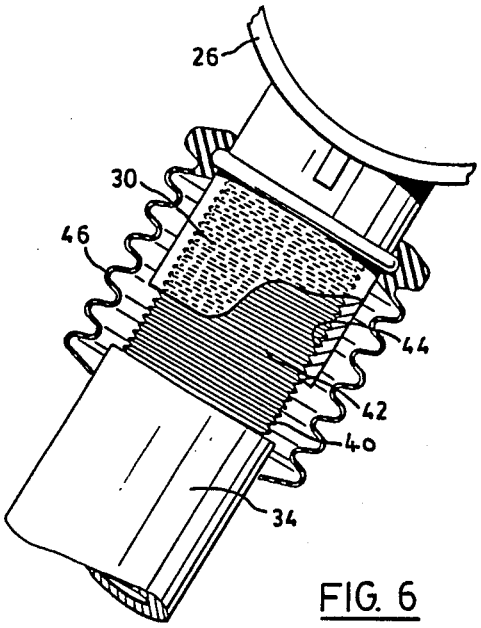
FIG. 6 is a fragmented, expanded view of a leg joint in one of the support members of the desk.

It will be appreciated that particular embodiments of the invention have been described, and that modifications may be made therein without departing from the spirit of the invention or the scope of the appended claims. In particular, as regards the method of attachment of the leg 34 to the socket 30, for example, as shown in FIG. 6, it will be appreciated that the socket member 30 can be formed with the threaded nipple 44 and the leg 34 with an internal thread at the top thereof. This will not materially affect the leg joining method disclosed, and is contemplated as part of the present invention. Also, of course, the particular materials and dimensions given may vary.

We claim:

1. A desk comprising:

a work top defining a work surface;

a base supporting the top and comprising a generally horizontal structural member disposed below and adjacent the top generally centrally thereof, and first and second support members spaced along the structural member and each including: a hub embracing the structural member, at least one leg extending downwardly from the structural member, and a work top support above the structural member to which the work top is coupled, the structural member having a hollow interior region;

first electrical connection means accessible at a first end portion of said structural member, second electrical connection means accessible intermediate said first end portion and a second end portion of said structural member, and electrical wiring means located within said hollow interior region for electrically connecting the first and second electrical connection means.

2. A desk as claimed in claim 1, wherein the first and second support members are structurally connected only by the generally horizontal structural member.

3. A desk as claimed in claim 1, wherein the first electrical connection means is mounted in an end face at said first end portion of the generally horizontal structural member.

4. A desk as claimed in claim 1, 2 or 3 further comprising third electrical connection means mounted in an end face at said second end portion of the generally horizontal structural member and connected to said electrical wiring means.

5. A desk as claimed in claim 1, wherein the hollow internal region of the structural member is divided into two separate compartments, wherein the electrical wiring means includes first wiring means located in one of the compartments and second wiring means located in the other of the compartments, wherein the first electrical connection means includes first connector means electrically connected to the first wiring means and second connector means electrically connected to the second wiring means, and wherein the second electrical connection means includes first connector means electrically connected to the first wiring means and second connector means electrically connected to the second wiring means, whereby electric power and electrical signals can be transmitted between the first and second electrical connection means in separate compartments in the structural member.

6. A desk as claimed in claim 5, wherein third electrical connection means are located at said second end portion of the structural member, the third electrical connection means including first connector means electrically connected to the first wiring means and second connector means electrically connected to the second wiring means whereby electric power and electrical signals can be transmitted between the first and third electrical connection means.

7. A desk as claimed in claim 5 characterized in that the structural member includes a separate cap member distinct from the attached to the rest of the structural member, the second electrical connection means being mounted in an opening in the cap member.

8. A desk as claimed in claim 1, wherein the structural member is formed with at least one external, longitudinal groove with undercut side walls, and wherein at least one of a nut and threaded male fastener is retained in sliding engagement in the undercut side walls, the one of the nut and threaded fastener being slidable along the groove.

9. A desk as claimed in claim 1, wherein the structural member is formed with a plurality of longitudinal grooves each having undercut side walls, a sliding nut is retained in the undercut side walls of each of the grooves and, a work top support member is located intermediate the first and second support members and supports the work top from the structural member, the work top support member being secured to the structural member by means of threaded fasteners which threadedly engage the sliding nuts.

10. A desk as claimed in claim 1, wherein the hub of each of the support members is formed with a pair of internally threaded sockets and two said legs each have an externally threaded end portion threadedly engaged within one of the sockets, the legs of each support member diverging away from the work top.

11. A desk as claimed in claim 1, wherein the structural member includes two compartments which extend from end to end of the member for receiving respectively electrical and communications wiring and which have open lower sides, and closure means normally closing said open lower side of the compartments but adapted to be opened at appropriate times.

12. A desk as claimed in claim 11, wherein said closure means comprises respective hinged doors extending over the entire length of the structural member and each adapted to close one of said compartments, and means normally retaining said doors in closed positions.

13. A desk as claimed in claim 12, wherein said structural member is formed by three extrusions, each of constant cross-sectional shape throughout its length, two of said extrusions defining said doors and the third defining the remainder of the structural member, the extrusions being shaped to define hinged connections between the doors and third extrusion.

14. A desk as claimed in claim 1, wherein each of said hubs comprises respective upper and lower hub parts independently coupled to the structural, the upper hub part carrying said work top support and the lower hub part being coupled to said leg.

15. A desk as claimed in claim 14, wherein said structural member defines a plurality of longitudinally extending undercut grooves, and wherein the hubs include means adapted to lock each hub part in appropriate ones of said grooves independently of the other hub part.

16. A desk as claimed in claim 15, further comprising a structural members connector assembly including respective connector parts coupled together and adapted to be joined end to end with the beams of adjacent similar desks, each said part defining grooves aligning with at least some of said grooves of the members, whereby the members and connector assembly may be coupled together end to end by locking means engaged in said grooves.

17. A desk as claimed in claim 1, wherein each said leg comprises a cylindrical leg member having a foot at its outer end provided with a level adjusting device in the form of an eccentric wheel adapted to be locked in any of a plurality of eccentric positions for varying the effective height of the leg.

* * * * *